US007726040B2

(12) United States Patent
Yanes

(10) Patent No.: US 7,726,040 B2
(45) Date of Patent: Jun. 1, 2010

(54) APPARATUS AND METHOD FOR THE UNIFORM DRYING OF BOARD MATERIALS

(75) Inventor: Felipe J. Yanes, Tampa, FL (US)

(73) Assignee: CertainTeed Gypsum, Inc., Tampa, FL (US)

( * ) Notice: Subject to any disclaimer, the term of this patent is extended or adjusted under 35 U.S.C. 154(b) by 476 days.

(21) Appl. No.: 11/580,699

(22) Filed: Oct. 13, 2006

(65) Prior Publication Data

US 2008/0086905 A1 Apr. 17, 2008

(51) Int. Cl.
*F26B 3/00* (2006.01)

(52) U.S. Cl. ..... 34/477; 34/443; 34/479; 34/86; 34/205; 34/212

(58) Field of Classification Search ..... 34/611, 34/612, 205, 309, 377, 378, 379, 443, 450, 34/448, 477, 478, 479, 86, 212, 219
See application file for complete search history.

(56) References Cited

U.S. PATENT DOCUMENTS 951,858 A * 3/1910 Turlur ..... 34/86
1,656,802 A * 1/1928 Vance ..... 34/205
1,776,014 A * 9/1930 Vance ..... 236/44 R
2,266,489 A 12/1941 Camp
2,573,355 A * 10/1951 Powers et al. ..... 34/611
2,909,850 A 10/1959 Loechl
2,996,811 A 8/1961 Loechl
3,001,298 A * 9/1961 Blesch et al. ..... 34/212
3,043,014 A 7/1962 Loechl
3,088,218 A * 5/1963 Loechl ..... 34/309
3,140,929 A 7/1964 Johanson
3,435,535 A * 4/1969 Blair ..... 34/309
3,863,361 A 2/1975 Gerhardt
3,911,593 A 10/1975 Colapinto
5,263,265 A 11/1993 Melgaard
5,440,101 A 8/1995 Cox et al.
5,659,975 A 8/1997 Bahner et al.
6,533,577 B2 3/2003 Anderson et al.
6,837,706 B2 1/2005 Straetmans et al.

* cited by examiner

*Primary Examiner*—Kenneth B Rinehart
*Assistant Examiner*—Corey Hall
(74) *Attorney, Agent, or Firm*—GrayRobinson, P.A.

(57) ABSTRACT

Disclosed is an apparatus and method for the uniform drying of boards, such as gypsum wallboards. The apparatus includes a dryer through which a series of boards are conveyed in a side-by-side relationship. While in the dryer, heated air is delivered over the boards via a series of separate air channels. A bypass duct delivers a portion of or a totality of unreheated air to the outermost channels where the cooler air displaces a volume of the warmer air. As a result, the air in the outermost channels is cooler than the air in the interior channels. Air from the outermost channels is then directed over the exposed longitudinal edges of the boards.

10 Claims, 7 Drawing Sheets

APPARATUS AND METHOD FOR THE UNIFORM DRYING OF BOARD MATERIALS

BACKGROUND OF THE INVENTION

1. Field of the Invention

This invention relates to an apparatus and method for drying board materials. More particularly, the present invention relates to an improved drying method and apparatus wherein cooler air at widely-varying and well controlled temperatures is directed to the areas of boards most susceptible to overdrying.

2. Description of the Background Art

The use of board dryers is known in the prior art. One application for board dryers is in the manufacture of gypsum wallboard. Gypsum wallboard is made by placing a gypsum slurry between two continuous paper sheets. This laminate is then shaped, cut into appropriately sized lengths, and dried. The present invention is an improved board drying apparatus and method.

In particular, the present invention is directed at overcoming problems of excessive and uneven board drying inherent in prior art. Most board dryers deliver an airstream of a uniformly high temperature over a number of boards as they travel along a conveyor. However, because boards typically are arranged on the conveyor alongside one another in an array, an uneven drying is achieved. This occurs because the wet boards on the conveyor act as a heat sink. This heat sink greatly reduces the temperature of the airstream delivered over the boards. Moreover, the effect of this heat sink is greatest for the interior boards of the array because they are surrounded by other boards. Alternatively, the effects of the heat sink are minimized for the exposed external edges in the board because there are no adjacent boards present. As a result, in prior board dryers the outside edges of the boards are exposed to higher temperature airflows and are more susceptible to overdrying, thermal damage and discoloration. The interior boards of the array, and their corresponding edges, are exposed to cooler temperatures, thereby minimizing the possibility of overdrying. The present invention is aimed at eliminating overdrying and achieving a uniform drying of board materials The background art contains many examples of improved board dryers. For instance, U.S. Pat. No. 3,140,929 to Johanson generally teaches the use of devices for rapid and effective cooling of dried wall-board sheets for efficient stacking and storing of the finished sheets without risk of damage. In particular, dampers are used to make possible a commingling of local air into supplied cooling air for complete cooling of already dried boards.

Additionally, U.S. Pat. No. 3,435,535 to Blair discloses methods for drying gypsum boards, while not overdrying their edges. The devices used to prevent such overdrying comprise a series of ducts, and a system of superposed arrays of ducting, wherein under-walls of each duct are provided with a plurality of apertures to permit air jets to be expelled downwardly so as to impinge upon the marginal areas and around the edges of the wallboard. The effect of the multiplicity of air jets is to form side curtains as a partial barrier to the main or central hot air streams of each passageway and to form jets of air directed toward the board edges so that the hot air streams become mixed with the cool air flowing from the apertures (and the temperature of the air is reduced at the locations near the edges of the wallboard).

Still yet another example is provided by U.S. Pat. No. 2,909,850 to Loechl. This patent is directed to modifying dryer apparatuses to protect the edge portions of drying gypsum boards from being over-dried and calcined. The edge portions of the board being dried are protected from the rapid circulation of the hot drying medium. This protection allows for the maintenance of temperatures higher than normal in the drying of the gypsum board and protection for the edges of the board from over-drying with subsequent calcination. For the desired isolation of the edge portions of boards being conveyed through the dryer, there is a partition-like construction which is positioned toward each end of the conveyor roll series. This protective partition is mounted and spaced somewhat inwardly from the ends of the rolls for the purpose of protecting the board edges from calcination while being dried.

Finally, U.S. Pat. No. 3,043,014 to Loechl is directed to a process for applying at the end edges a coolant which retards the rate of evaporation of water from the end portions of the board to the extent that the end portions of the board dry at the same time as the body portion of the board. This allows for the end edge portions, not being dried prior to the drying of the main body portion, resist recalcination during drying. The application of the coolant proceeds via spraying.

Although each of the above referenced inventions achieves its individual objective, they all suffer from common drawbacks. The improved drying apparatus and method of the present invention is aimed at overcoming these drawbacks.

SUMMARY OF THE INVENTION

It is therefore one of the objectives of this invention to provide an improved board drying apparatus and method that protects the side edges of boards from overdrying, thermal damage and/or discoloring.

It is also an object of this invention to concentrate a controlled, cooler airstream over the exposed external edges of boards and to concentrate warmer airstreams over internal unexposed edges, whereby a more uniform board drying is achieved.

Still another object of this invention is to provide an improved board drying apparatus that displaces higher temperature air with unheated air and delivers that air to the marginal areas of the boards to prevent overdrying.

These and other objectives are carried out by an apparatus for the uniform drying of boards. The invention comprises a conveyor serving to transport one or more boards with each board having exposed side edges that are susceptible to over heating. The apparatus includes a delivery plenum having a series of internal vanes defining interior and exterior channels. A primary duct is provided for delivering heated air to the interior and exterior channels of the delivery plenum. A bypass duct is also provided that is physically separate from the primary duct for delivering cooler air into the exterior channels of the delivery plenum. The cooler air delivered to the exterior channels displaces the heated air from the primary duct. A nozzle box is positioned adjacent to the conveyor for delivering air from the interior and exterior channels of the delivery plenum to the boards. Air flows from the nozzle box in channels whereby cooler air from the external channels impinges upon the exposed edges of the boards.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The present invention relates to an improved board drying apparatus and method. The invention involves delivering channels of warm air over the surface of a number of boards in a dryer. High temperature air in the outermost air channels can be partially displaced by cooler, unreheated air. The cooler air in these outermost channels is then directed to the areas of the boards most susceptible to overdrying. The various aspects of the present invention, and the manner in which they interrelate, will be described in greater detail hereinafter.

Figure 1:
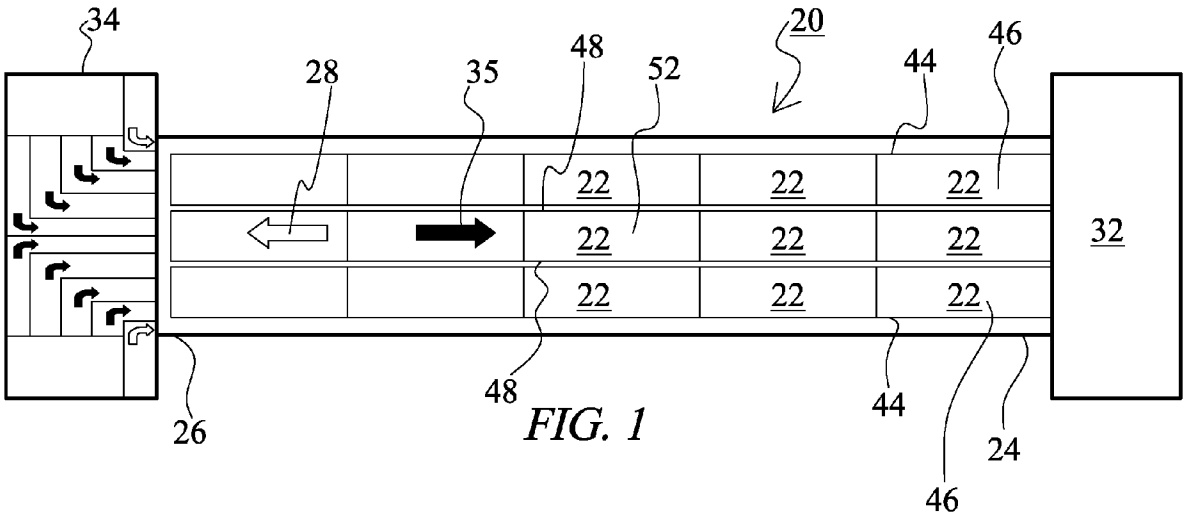
FIG. 1 is a plan view of the board dryer of the present invention.

One of the objectives of the present invention is to prevent overdrying, thermal damage and discoloration to boards as they are being dried. In prior art dryers, such as gypsum board dryers, wet boards are transported through a dryer wherein warm air is delivered from a plenum and distribution nozzle boxes over the boards. This air is directed over top and/or bottom of the boards as they are being transported via a series of conveyors. These conveyors can be stacked on top of one another, six, eight, or more conveyors high, to maximize the residence time and evaporative capacity for the product traveling through the dryer (note FIG. 2). Additional drying capacity is achieved by orienting the boards upon the conveyor in a side-by-side relationship. For example, two, three or four boards can be arranged next to one another on the conveyor in an array. An example of a three board array is illustrated in FIG. 1. As illustrated, the respective longitudinal edges of the boards are parallel to one another. The two outermost boards each have one exposed longitudinal edge, while the innermost board, or boards, of the array has two unexposed edges.

Figure 3:
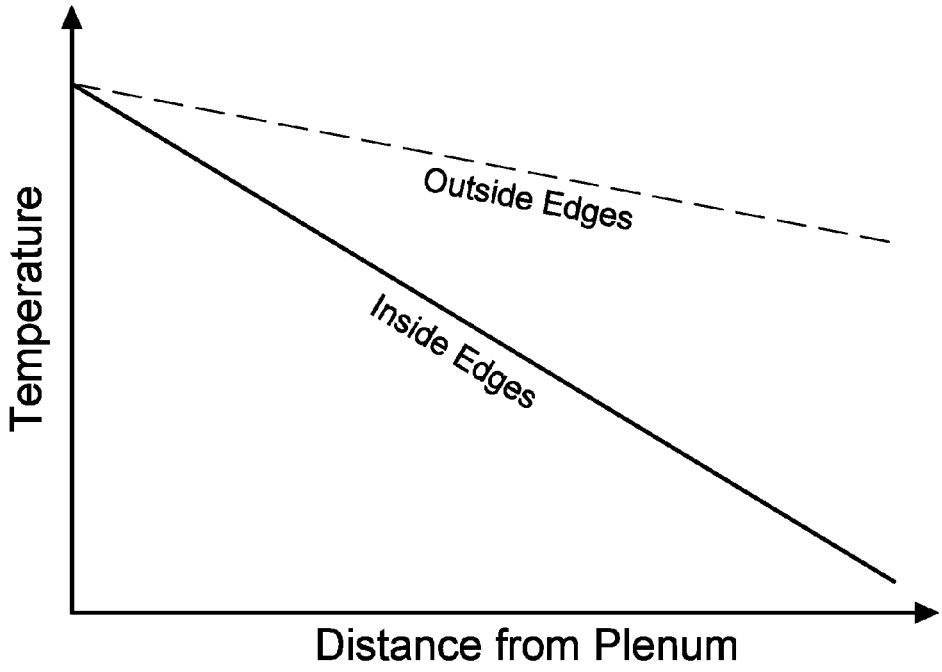
FIG. 3 is a graph illustrating the relative cooling of the exposed and unexposed edges of transported boards using drying devices of the prior art.

While this arrangement has the advantage of increasing the number of boards being transported through the dryer, it has an undesirable thermodynamic effect. Namely, the air flowing over the innermost boards of the array contacts more board surface area than the air flowing over the outermost boards of the array. Because wet boards act as a heat sink, the air flowing over the innermost boards cools more rapidly. This thermodynamic phenomenon has the most effect upon the longitudinal edges of the boards. Thus, the exposed edges of the outermost boards of the array are least affected by the heat sink and the unexposed edges of the innermost boards are most affected. As a result, air flowing over the outermost exposed edges retains its heat over a greater distance which can result in overdrying. This drawback of prior art dryers is shown in the graph of FIG. 3. Namely, as air is delivered out of the plenum, the air impinging the inside edges of the boards cools more quickly than the air impinging upon the outside edges. Again, the result is an overdrying of the outside edges.

With reference now to FIG. 1, a plan view of the drying apparatus 20 of the present invention is depicted. The apparatus depicted is a gypsum board dryer. The invention, however, is applicable to any convection-dried product, including but not limited to wood fiber, perlite, composite, and mineral wool boards. In this figure, a number of boards 22, which in this example are positioned in a three board array, are being transported from a first location 24 to a second location 26 along a first direction of travel 28. FIG. 1 depicts just a single dryer or dryer zone 20. However, dryer 20 could be one in a number of sequentially arranged dryers. Plenums are located at the first and second locations (24 and 26) and mark the beginning and end of a drying zone. The first plenum is a return plenum 32 for collecting air to be used in drying boards 22. The second plenum is a delivery plenum 34 for routing high temperature air over boards 22. In the preferred embodiment, the air is delivered over boards 22 in channels that flow in a direction 35 that is opposite to the direction 28 of board travel. The principle described herein applies similarly well in dryer zones where the air flow is in the same direction as the product. Indeed, it is customary in most dryer zones to use parallel flow. As described more fully hereinafter in conjunction with FIG. 4, both a primary and a bypass duct (36 and 38) are used to interconnect two plenums 32 and 34. Although the depicted example is a three board array, the present invention can just as easily be a two, four or five board array. The use of even larger arrays is also within the scope of the invention, as is the use of a single board array, typically used in fiberboard and mineral wool dryers. Whatever the size of the array, the exposed edges 44 of the outermost boards 46 will be most susceptible to overdrying and thermal damage and the unexposed edges 48 of the innermost boards 52 are least susceptible.

Figure 2:
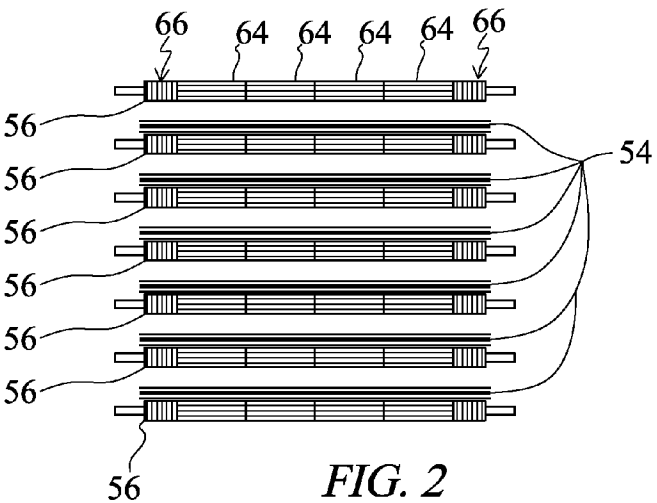
FIG. 2 is an elevational view showing the multi-deck dryer of the present invention.

In addition to positioning boards 22 in an array, board throughput can be increased further still by positioning the conveyors in a stack 54. FIG. 2 is an illustration of the multi-deck arrangement of the dryer of the present invention. Namely, a series of six conveyors are stacked one on top of another to increase the number of boards passing through dryer 20 at any given time. Although a six conveyor stack 54 is depicted, higher stacks can also be used. Delivery plenum 34 is used to supply an airflow over each of these conveyors.

Figure 4:
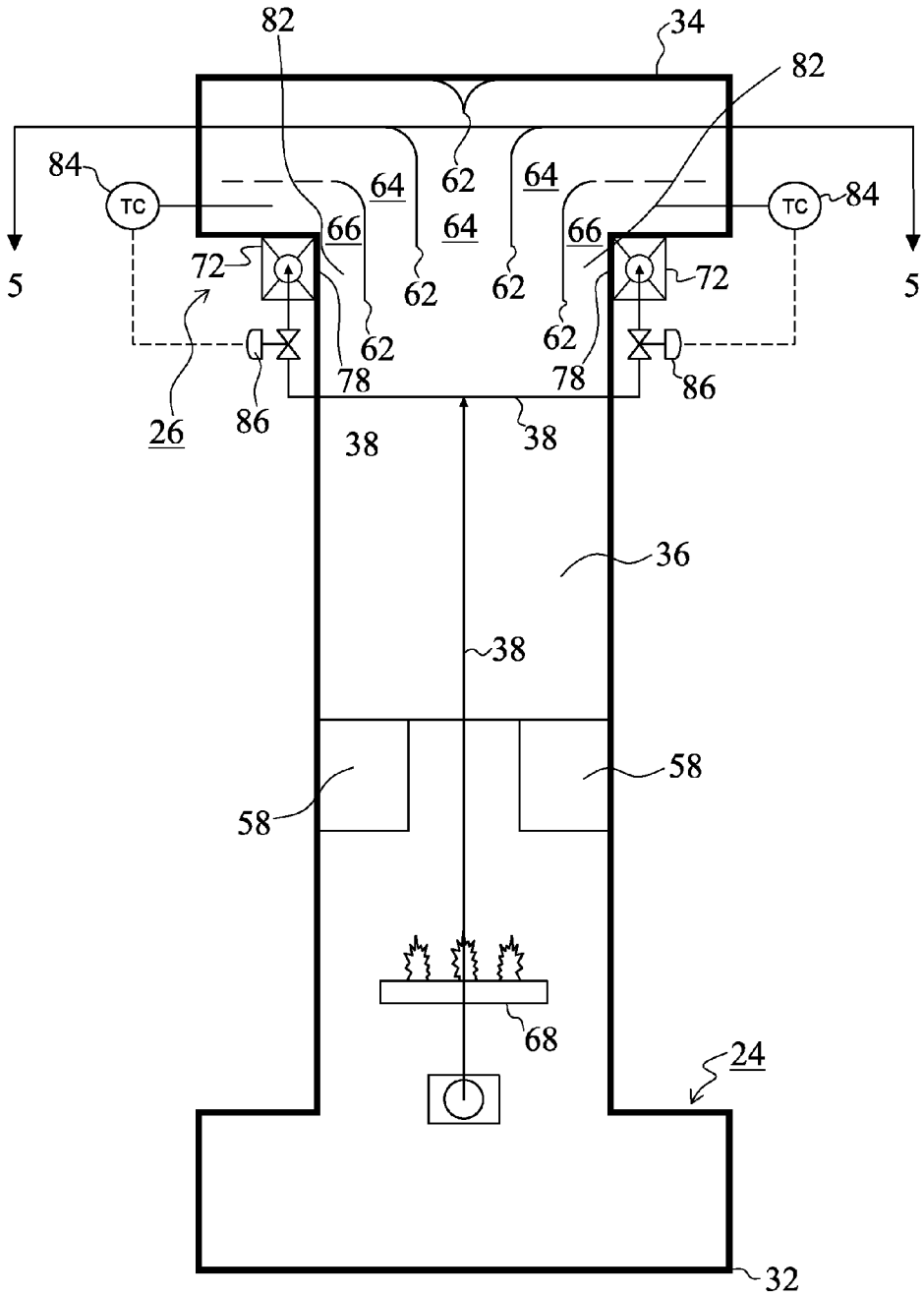
FIG. 4 is a plan view of the delivery plenum and primary and bypass ducts of the drying apparatus of the present invention.

The potential for overdrying exposed edges 44 in the array is eliminated via the use of primary and bypass ducts (36 and 38) as illustrated in FIG. 4. FIG. 4 is a plan view illustrating the primary and bypass ducts (36 and 38) that are used to interconnect the delivery and return plenums. The ducts and plenums are preferably located above the conveyor stack 54. As explained more fully hereinafter in conjunction with FIG.

5, a series of nozzle boxes 56 are used to redirect the air flow from above conveyor stack 54 to a direction over each of the individual conveyors. Air is gathered by the return plenum 32 and delivered to a heater or burner 68 via primary duct 36. One or more circulation booster fans 58 positioned within primary duct 36 help transport the heated air to delivery plenum 34. Delivery plenum 34 includes a series of vanes 62 that define a number of air channels. These air channels are both physically separate and may be thermally isolated. In the preferred embodiment, and again as depicted in FIG. 4, vanes 62 define three internal channels 64 and two external channels 66. Other channel arrangements can also be employed. The primary duct 36 delivers heated air into all of these channels.

Bypass duct 38 is employed to deliver a volume of cooler, unheated or cooler, unreheated air to external channels 66 of plenum 34. With continuing reference to FIG. 4, bypass duct 38 takes air from the return plenum 32 and delivers it directly to two edge cooling boxes 72. Bypass duct 38 is physically separate from primary duct 36 and is not exposed to burner 68 or any other heating element. Thus, the air delivered by bypass duct 38 is unreheated and therefore cooler than the air delivered by primary duct 36.

Figure 6:
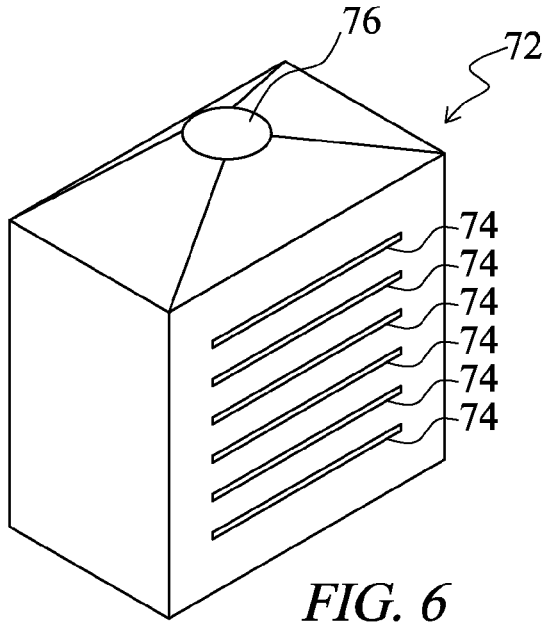
FIG. 6 is a detailed view of one of the edge cooling boxes of the present invention.

Each of the cooling boxes 72 functions to deliver unreheated air into external channels 66 of delivery plenum 34. FIG. 6 is a detailed view of one cooling box 72. As illustrated, the box includes a series of slots or vents 74 upon an outer face as well as an intake aperture 76 at its upper end. Air from bypass duct 38 is delivered into inlet 76 and is delivered to external channels 66 via slots 74. To achieve this, apertures 78 are formed through the wall of delivery plenum 34 to allow for the delivery of air from slots 74 of cooling box 72 to exterior channels 66. Slots 74 of cooling box 72 are thus in fluid communication with external channels 66 of delivery plenum 34. The area beyond slots 74 and within the external channels 66 is a blending point 82 where the warmer air from the primary duct 36 blends with the unreheated air from bypass duct 38. Each cooling box 72 further includes a temperature regulation mechanism. This mechanism takes the form of a temperature controller 84 and an associated damper 86. The mechanism controls the volume of unheated air leaving its respective cooling box 72. This, in turn, allows an operator to selectively control the amount of unreheated air that is ultimately delivered into the exterior channels 66. By regulating the temperature control mechanism, a user can make the temperature within the external channels 66 lower than the temperature of the air within the internal channels 64. Conversely if desired, the temperature control mechanism can be adjusted so that no unreheated air is delivered to the external channels 66, whereby the air in all of the channels (64 and 66) of delivery plenum 34 will be uniform.

The invention, therefore, provides a widely variable temperature control at the edges as needed by the specific dryer application. Any air temperature between the delivery plenum temperature and return plenum temperature can, therefore, be supplied to the outermost edges of the board. The apparatus is well suited not only for protecting the outer edges of board product during standard operation, but also in circumstance where the width of the boards passing through the dryer create more "outboard" space outside the outermost edges.

Figure 5:
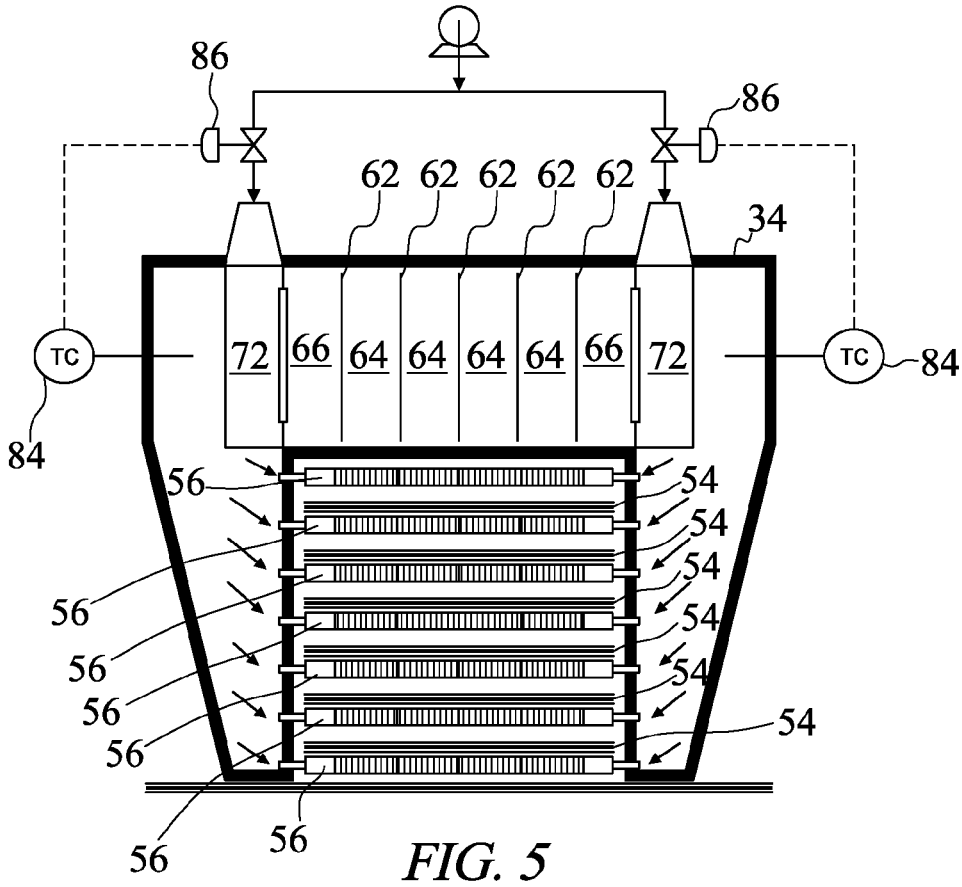
FIG. 5 is an elevational view taken the long line 5-5 of FIG. 4.
Figure 7:
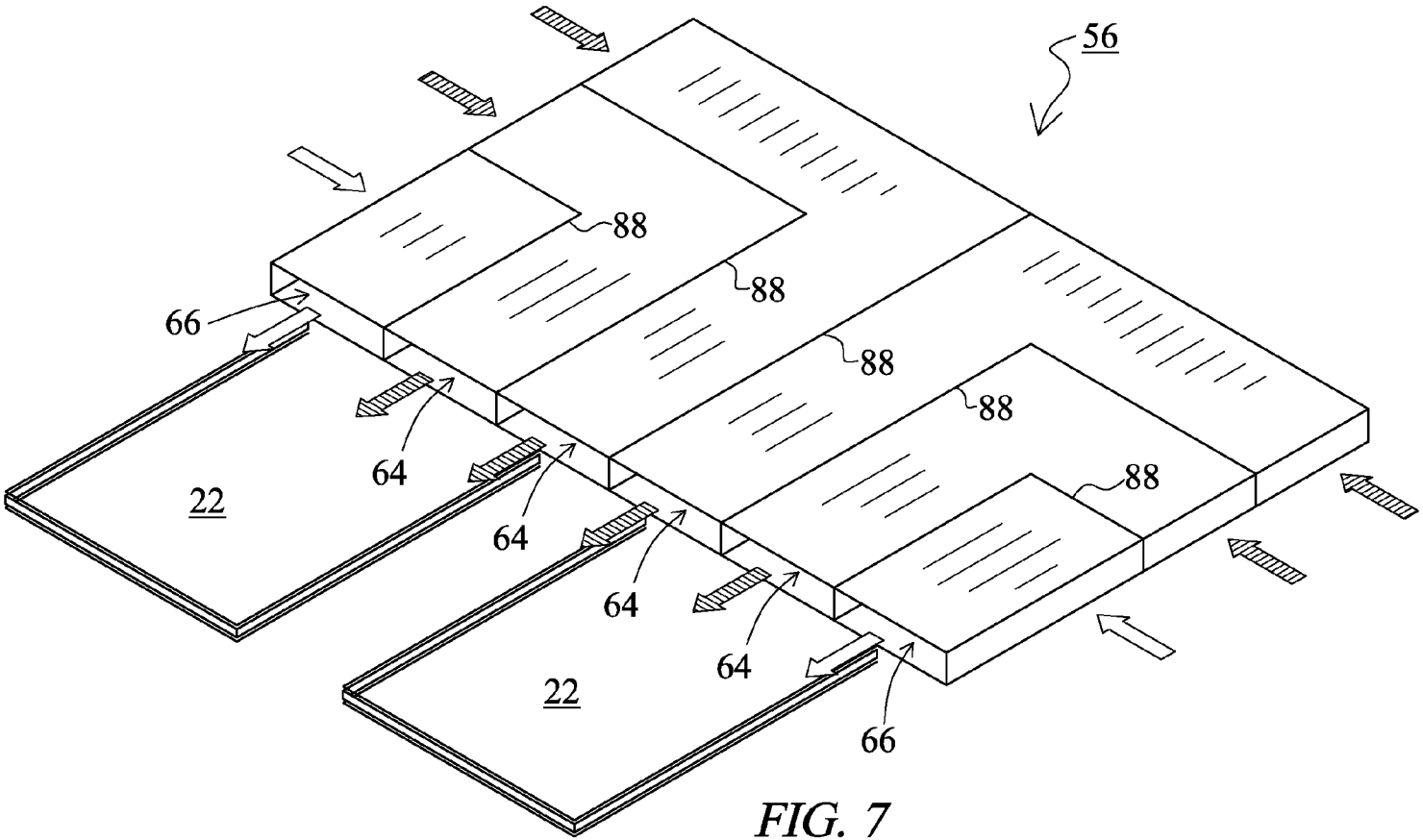
FIG. 7 is a perspective view of typical nozzle boxes distributing air over the board.

Air from delivery plenum 34 is then routed to a series of nozzle boxes 56. This routing is done with vanes to keep the air flowing in the respective channels (64 and 66). The arrangement of nozzle boxes 56 relative to the conveyors is illustrated with reference to FIG. 5. As depicted, nozzle boxes 56 are located at the second location 26 beneath delivery plenum 34 at positions both above and below each conveyor of the heater. For parallel flow dryer zones, the nozzles are located at the first plenum. As illustrated in FIG. 7, each nozzle box 56 includes vanes 88 that correspond to vanes 62 in delivery plenum 34 to maintain the integrity of the respective air channels. Thus, the heated air of internal channels 64 remains physically and thermally isolated from the cooler air of external channels 66. FIG. 5 illustrates the position of the nozzle boxes 56 and shows how the exiting air is delivered over boards 22 in a direction 35 that is, in this case, opposite to the direction of travel 28. By way of the drying apparatus 20 of the present invention, the cooler air from external channels 66 is delivered to the exposed edges 44 of the gypsum (or other) board while the warmer air from internal channels 64 is delivered to the unexposed edges 48 of the gypsum board. In this manner, the warmer air channel is delivered to the areas with the greatest heat sink and cooler air is delivered to the areas with less of a heat sink. Overdrying of the external edges is thus avoided.

Figure 8:
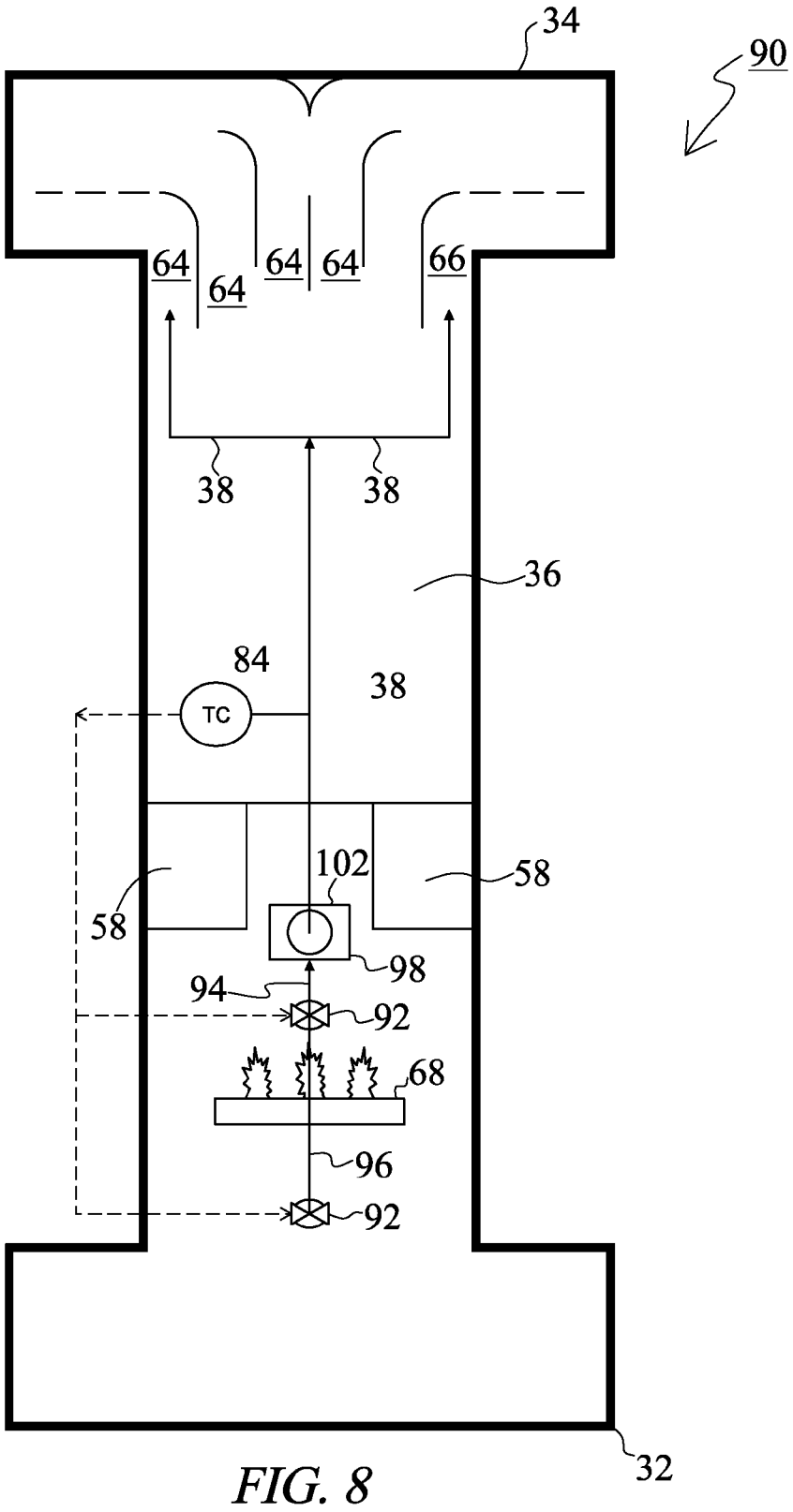
FIG. 8 is an alternative embodiment of the drying apparatus of the present invention.
Figure 9:
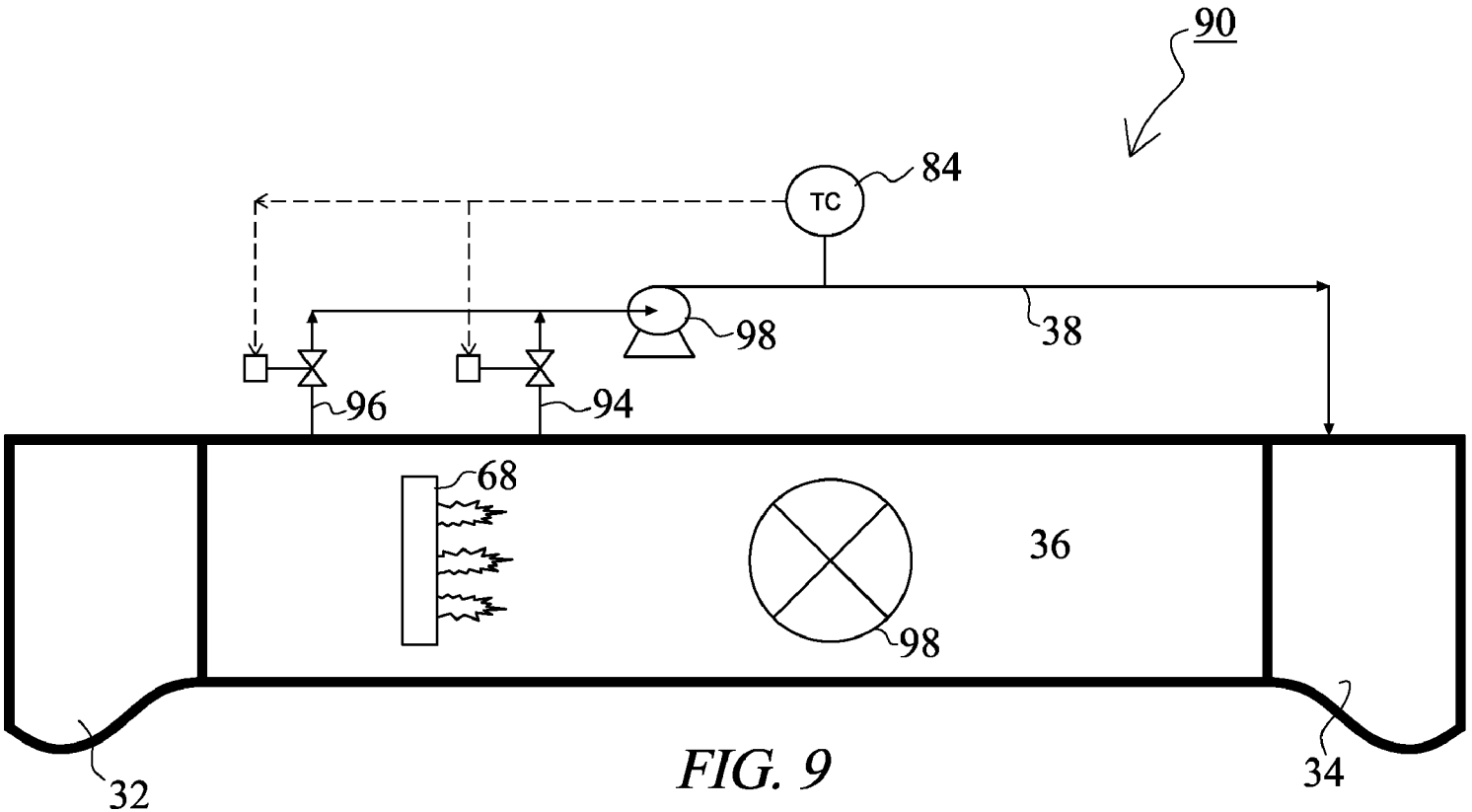
FIG. 9 is a side elevational view of an alternative embodiment of the drying apparatus of the present invention.

FIGS. 8 and 9 illustrate an alternative drying apparatus 90. In most respects this apparatus is the same as the apparatus 20 of the primary embodiment depicted in FIGS. 1-7. However, the alternative embodiment 90 eliminates the need for separate cooling boxes 72. Air control dampers 92 are used to combine heated and unheated airstreams (94 and 96) at a blending point 98 that is upstream of delivery plenum 34. After the air is blended, a booster fan 102 is used to transport the air to external channels 66 via bypass duct 38. A primary duct 36 is still employed to transport warmed heated air to both the internal and external channels (64 and 66) of delivery plenum 34. This embodiment is the same in all other respects to the primary embodiment. Namely, the cooler air from external channels 66 is delivered via nozzle boxes 56 to the peripheral areas of the boards 22. However, in the alternative embodiment, the blending point is not located in delivery plenum 34.

What is claimed is:

1. An apparatus for the uniform drying of one or more boards comprising:

a conveyor serving to transport one or more boards, the boards having exposed side edges that are susceptible to over heating;

a return plenum for collecting air to be used in drying the boards;

a delivery plenum having an entrance and an exit and a series of internal vanes defining interior and exterior channels;

a primary duct and a heater in fluid communication with the return plenum and functioning to deliver heated air to the interior and exterior channels of the delivery plenum;

a bypass duct in fluid communication with the return plenum but that is physically separate from the primary duct for delivering cooler air into the exterior channels of the delivery plenum, the cooler air delivered to the exterior channels displacing heated air from the primary duct at the entrance to the delivery plenum;

a nozzle box positioned adjacent to the conveyor for delivering air from the interior and exterior channels of the delivery plenum to the boards, the air flowing from the nozzle box in channels whereby cooler air from the external channels impinges upon the exposed edges of the boards.

2. The apparatus as described in claim 1 further comprising:

a temperature controller associated with the by-pass duct for regulating the amount of cooler air that is delivered into the exterior channels of the delivery plenum, whereby the temperature in the external channels can be maintained at a level that is equal to or lower than the temperature in the interior channels.

3. The apparatus as described in claim 1 wherein:

the direction of air flow from the nozzle box is opposite to the direction the boards travel on the conveyor.

4. The apparatus as described in claim 1 wherein:

the cooler air of the by-pass duct is created by blending heated and unheated air at a location that is upstream from the delivery plenum.

5. The apparatus as described in claim 4 further comprising:

a temperature controller for controlling the blending of the heated and unheated air, whereby the temperature of the air being delivered to the external channels is controlled.

6. The apparatus as described in claim 1 wherein the heater is a burner for heating air within the primary duct and wherein air within the by-pass duct remains unheated.

7. The apparatus as described in claim 6 further comprising:

vented cooling boxes associated with each external channel, wherein air from the by-pass duct is routed to the external channels by way of the vented cooling boxes.

8. The apparatus as described in claim 7 further comprising:

a temperature controller associated with each vented cooling box, the temperature controller regulating the volume of air leaving the vented cooling boxes.

9. An apparatus for the uniform drying of a plurality of boards, the apparatus comprising:

a stack of conveyors, each conveyor in the stack extending from a first to a second location and serving to transport the plurality of boards in a first direction, each board having interior and exterior areas, with the exterior areas comprising elongated side edges, the plurality of boards being positioned on each conveyor in an array such that the respective side edges are parallel to one another, whereby some side edges of the boards are exposed and some side edges of the boards are unexposed;

a return plenum at the first location for collecting air to be used in drying the interior and exterior areas of the boards;

a delivery plenum at the second location, the delivery plenum having an entrance and an exit and a series of internal vanes defining a number of interior channels and two exterior channels;

a primary duct and an associated heater in fluid communication with the return plenum, the primary duct delivering heated air to the interior and exterior channels of the delivery plenum;

two edge cooling boxes, each edge cooling box being positioned adjacent a corresponding exterior channel of the delivery plenum, each edge cooling box having an inlet and a series of slots, the series of slots of each edge cooling box being in fluid communication with the respective exterior channel;

a bypass duct in fluid communication with the return plenum, the bypass duct being physically separate from the primary duct for delivering unheated air into the inlets of the cooling boxes, through the series of slots and into the exterior channels of the delivery plenum, the unheated air delivered to the exterior channels displacing heated air from the primary duct at the entrance of the delivery plenum;

a temperature controller associated with each of the edge cooling boxes for regulating the amount of unheated air that is delivered into the corresponding exterior channels of the delivery plenum, whereby the temperature in the two external channels can be maintained at a level that is equal to or lower than the temperature in the interior channels;

a series of nozzle boxes, the nozzle boxes positioned at locations above and below each of the conveyors of the stack of conveyors at the second location, each nozzle box delivering air from the interior and exterior channels of the delivery plenum to the boards of an associated conveyor, the air being delivered to the boards in a second direction that is opposite to the first direction, whereby air from the external channels impinges upon the exposed edges of the boards and the air from the internal channels impinges upon the unexposed edges of the boards.

10. A method for uniformly drying a plurality of boards during transport on a conveyor, the method utilizing a delivery plenum having an entrance and interior and exterior channels, as well as primary and by-pass ducts that are in fluid communication with a single return plenum, the method comprising:

positioning the plurality of boards in an array on the conveyor such that respective side edges of the boards are parallel to one another, whereby some side edges of the boards are exposed and some side edges of the boards are unexposed;

conveying the plurality of boards in a first direction on the conveyor;

delivering air from the return plenum to the primary duct and heating the volume of air within the primary duct;

delivering the volume of heated air from the primary duct to the interior and exterior channels of the delivery plenum;

delivering a volume of cooler, unheated air from the return plenum to the external channels of the delivery plenum via the by-pass duct, whereby the heated air in the external channels is displaced at the entrance of the delivery plenum and becomes cooler than the air within the internal channels;

allowing the air from the delivery plenum to flow over the boards in channels, the air flowing in a direction that is opposite to the first direction, whereby the cooler, unheated air from the external channels flows over the exposed side edges of the boards and the heated air flows over the unexposed side edges of the boards.

* * * * *